United States Patent [19]

Starr

[11] 4,293,132

[45] Oct. 6, 1981

[54] SKIDWHEEL GAME

[76] Inventor: Louis J. Starr, 1460 S. Norton Ave., Los Angeles, Calif. 90019

[21] Appl. No.: 61,630

[22] Filed: Jul. 30, 1979

[51] Int. Cl.[3] ..... A63F 3/00

[52] U.S. Cl. ..... 273/126 R; 273/1 A

[58] Field of Search ..... 273/126 R, 85 R; 46/220

[56] References Cited

U.S. PATENT DOCUMENTS

| | | | |
|---|---|---|---|
| 336,179 | 2/1886 | Vogelsang | 273/126 R |
| 445,016 | 1/1891 | Greene | 273/126 R |
| 960,512 | 6/1910 | Darrou | 273/126 R |
| 1,296,111 | 3/1919 | Olson | 273/126 R |
| 1,300,526 | 4/1919 | Watson | 273/126 R |
| 1,551,981 | 9/1925 | Dette | 273/126 R |
| 3,768,809 | 10/1973 | Ciarfello | 273/1 A |

FOREIGN PATENT DOCUMENTS

| | | | |
|---|---|---|---|
| 848041 | 10/1939 | France | 46/220 |
| 871178 | 8/1936 | Sweden | 273/126 R |
| 421 | of 1869 | United Kingdom | 273/1 A |
| 575 | of 1895 | United Kingdom | 273/126 R |

*Primary Examiner*—Richard C. Pinkham
*Assistant Examiner*—T. Brown
*Attorney, Agent, or Firm*—Bruce A. Jagger

[57] ABSTRACT

An article of manufacture for and a method of playing the skidwheel game. The invention comprises a longitudinally disposed generally flat playing surface with a design thereon containing value zones, used in combination with automobile steering wheel playing piece having a generally circular periphery which is linearly projected with a reverse spin along the longitudinal axis of said playing surface such that said wheel generally rolls in contact with said surface first in one direction and then in the reverse direction and either comes to rest within one of said zones or traverses the entire length of said playing surface and returns to its starting point, the desired effect depending on the method selected to award points for each toss.

6 Claims, 4 Drawing Figures

SKIDWHEEL GAME

BACKGROUND OF THE INVENTION

1. Field of the Invention

In the toy and game industry, there is a heavy demand for a low cost, easily produced item that can be used by individuals or groups of all ages.

The present invention is directed toward the manufacture and method of playing such a game comprising a longitudinally disposed generally flat playing surface with a design thereon, used in combination with a wheel which is to be linearly projected along the longitudinal axis of said longitudinally disposed generally flat playing surface in a certain fashion. The game is easy to produce, can be easily learned by anyone, and can provide many hours of enjoyment for individuals and groups alike.

2. Description of the Prior Art

The general concept of using a longitudinal playing surface with value indicating indicia associated with various zones identified along the surface has been an element in many games. One example is the game of shuffleboard wherein a disc shaped object is projected by a cue along the playing surface which contains zones having values associated with them. The object of the game is to have the disc shaped object come to rest within one of the zones.

The general concept of using a wheel has been an element in many toys and games. One example is the Hula Hoop which can be rotated around one's body or thrown and projected.

SUMMARY OF THE INVENTION

The present invention relates to a skidwheel game comprising a longitudinally disposed generally flat playing surface containing an elongated design with a plurality of zones having value indicating indicia thereon. The game is played utilizing a wheel which has a circular periphery. The playing piece is projected linearly with a reverse spin along the longitudinal axis of the design. The playing surface which supports the design can be a fixed permanent rigid surface such as a floor or a flexible transportable surface such as a rubber mat or other flexible membrane. In use the flexible membrane is supported by a rigid substrate. The surface comprises a generally rectangular perimeter marker and a plurality of zones separated from each other by transversely extending zone markers. The zones which are thus defined include value indicating indicia associated with individual ones of said zones. A wheel or other playing piece which contains either a solid core or is hollow within its center is used in combination with the surface. A player, standing adjacent to one end of the elongated design projects the playing piece with a reverse spin along the longitudinal axis of the design such that the wheel generally rolls in contact with the surface first in one direction away from the player and then in the reverse direction toward the player in such a fashion that it either comes to rest within one of the zones or comes back entirely the length of the playing surface to the player, the desired effect depending on the method selected to award points for each toss.

This skidwheel game can be played by all age groups, as individuals or in teams, both indoors and outdoors, using a permanent or removable surface with various scoring designs on it, and using various generally circular playing pieces. The game will provide many hours of enjoyment to its players.

BRIEF DESCRIPTION OF THE DRAWINGS

Referring particularly to the drawings for the purposes of illustration only and not limitation there is illustrated.

DETAILED DESCRIPTION OF THE PREFERRED EMBODIMENT

Figure 1:
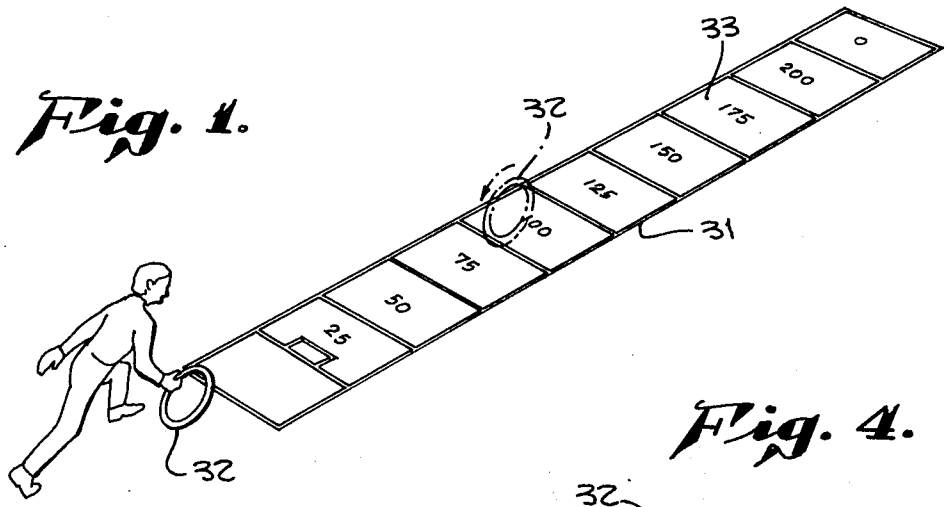
FIG. 1 is a perspective view of the presently preferred form of the invention and a demonstration of how the wheel is to be projected along the longitudinal axis of the longitudinally disposed generally flat playing surface while playing the game.

With reference to the drawings in detail and more particularly to FIG. 1 thereof, there is illustrated a longitudinally disposed generally flat playing surface 31 with a design 33 thereon used in combination with a wheel 32.

Figure 2:
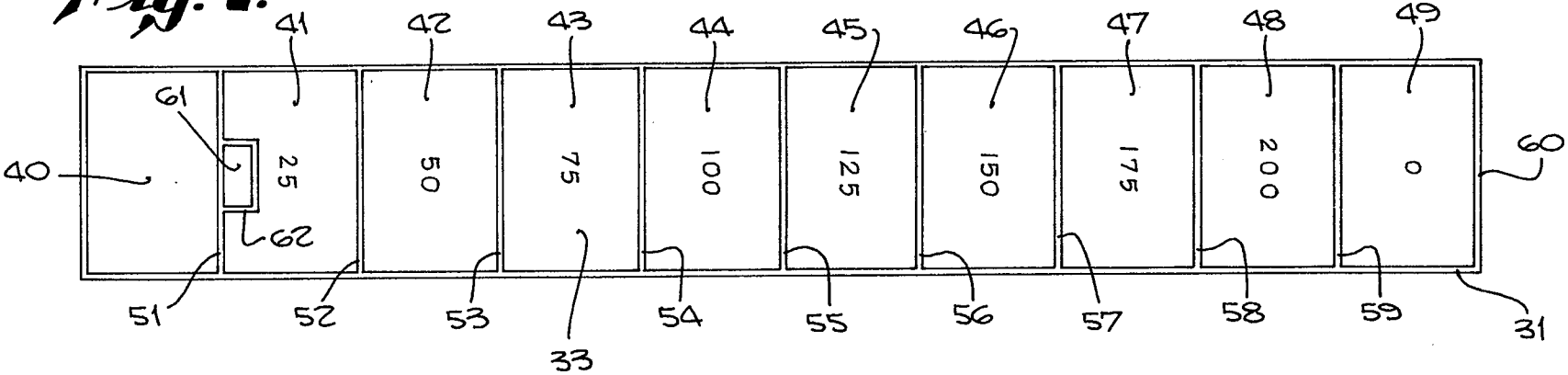
FIG. 2 is a top plan view of the longitudinally disposed generally flat playing surface.

FIG. 2 shows a detailed top plan view of the design 33 on longitudinally disposed generally flat playing surface 31. The surface 31 can be a permanent surface such as any smooth floor; for example, cement, wood, linoleum or tile; or it can be a transportable surface apart from the floor such as a rubber or plastic mat which can be rolled up to facilitate transportation and then unrolled and caused to lie upon a smooth surfaced substrate when in use as part of the game. The design 33 is placed upon the permanent or transportable surface by any one or more of several well known means such as painting, stenciling, pasting or gluing. The design itself can consist of paint or stenciling material or can be separate items made of material such as paper, plastic or tile which is permanently affixed to the permanent or transportable surface by any one or more well known methods such as glue, paste, nails or tacks.

Referring to FIG. 2 the design 33 comprises several elements. The design contains a generally rectangular blank zone 40 which is the starting box. The design contains a plurality of generally rectangular zones which are separated from each other by transversely extending boundary markers. There are value indicating indicia associated with individual ones of said zones. The zones are shown as 41 through 49 on FIG. 2 and the transverse boundary markers are shown as 51 through 59 on FIG. 2. By way of example only, the value indicating indicia associated with the individual ones of said zones can consist of a series of numerical numbers in ascending value as the distance from the starting box increases, and a value of 0 in the farthest zone, as shown in FIG. 2. It is also possible to value the zones in descending numerical value as the distance from the starting box 40 increases. As a further example, each zone can be a different color or have a symbol on it and a separate score sheet can assign a value to each color or symbol. By the way of example only, the zones could be marked as follows: zone 41 tin, zone 42 iron, zone 43 bronze, zone 44 platinum, zone 45 silver, zone 46 gold, zone 47 diamond, zone 48 star, and zone 49 a no value foul box which is black. Each of the boundary markers 51 through 59 are shown for illustration purposes as being straight horizontal lines. Each boundary marker can also be designed with numerous curves in it. The entire playing area is surrounded by an outside elongated generally rectangular perimeter or boundary marker shown as 60 in FIG. 2. This boundary marker 60 runs with parallel elements the full length of all the zones on both longitudinal edges and forms with transverse elements the front end of starting box 40 and the back end of the final zone 49. Contained within the first value zone 41 is a special plus 10% box shown as 61 surrounded by its boundary marker 62. By way of example only, on one embodiment the starting box 40 and each of zones 41 through 49 can be 23¼ inches long and 35¼ inches wide. Each of the boundary markers 51 through 59 can be ¾ inches wide and 35¼ inches long. The external perimeter or boundary marker 60 is ⅜ inches wide and surrounds the entire playing design. The plus 10% box is 8 inches long by 12 inches wide and its boundary marker 62 is ⅜ inches wide. Therefore, with the design as described, the playing surface is 20 feet by 3 feet wide. While the starting box 40, the plus 10% box 61, and the value zones 41 through 49 are shown as rectangular in design, this is by way of illustration only since these areas can encompass other shapes without departing from the spirit or scope of the invention.

Figure 3:
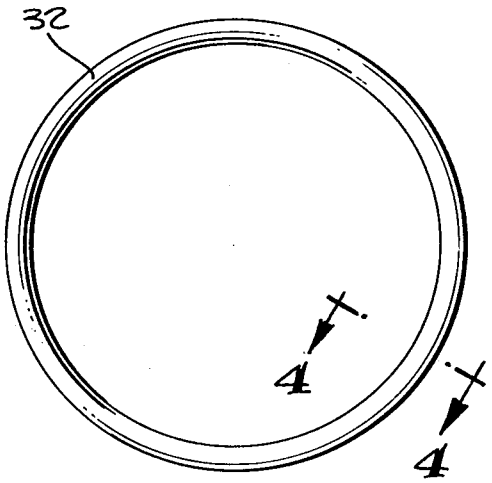
FIG. 3 is a plan view of a playing piece.
Figure 4:
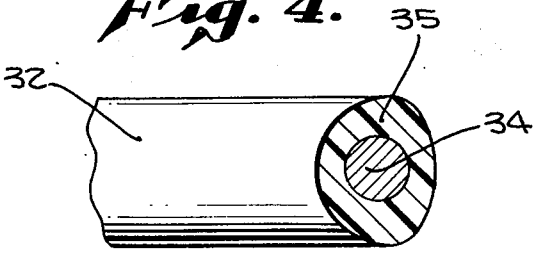
FIG. 4 is a cross-sectional view taken along line 4—4 of FIG. 3.

The playing piece 32 is shown in a plan view in FIG. 3. The playing piece in general consists of a circular frame of hard material that may be solid, partly solid or spoked and is capable of turning about a central axis. The cross section of the playing piece illustrated at 32 is shown in FIG. 4. The playing piece 32 contains a hard inner core 34 surrounded by a covering material 35. The wheel can be an automobile steering wheel wherein the hard inner core 34 is made of iron and the covering material 35 is made of plastic.

One method of playing the game is illustrated in FIG. 1. The player stands adjacent to one end of the playing surface and runs toward the surface. The player may enter starting box 40 but may not cross the first boundary line 51. Prior to reaching boundary line 51, the player projects the playing piece 32 linearly with a reverse spin along the longitudinal axis of the longitudinally disposed generally flat playing surface 31 in first one direction away from the players and then in the reverse direction toward the player. The wheel must remain within the internal border of the external boundary marker 60 at all times. If the wheel goes outside the boundary marker 60 on either of the two longitudinal edges or the horizontal edge at the rear of the farthest zone 49, the player receives 0 for his score. By way of example only, two types of scoring methods which may be used with the above described skidwheel game will be described. The first scoring method holds that the wheel must be projected with a reverse spin and when it comes to rest inside a zone, regardless of how far along the playing surface the wheel has traveled, the player receives the score associated with that zone. If the wheel lands between two zones, the player receives the score associated with the lower value zone. A second and different scoring method holds that the wheel must be projected with a reverse spin and must come back across the first boundary marker 51 in order for the player to score. If the wheel crosses boundary marker 51, the player receives the score associated with the highest value zone reached by the wheel before beginning its reverse spin back toward the player. If the wheel also goes through the plus 10% box on its way back, the player's score is multiplied by 10% and this amount is added to the score to obtain that total score on that toss. Numerous other scoring rules can be adopted for use with this game without departing from the spirit or scope of this invention. Each player receives a predetermined number of tosses, three for example, and his score is determined by selecting the highest score achieved on a single throw, the cumulative scores of all of his throws or by some variation on this scoring method.

This skidwheel game can be played by all age groups, as individuals or in teams, both indoors and outdoors, using a permanent or removable surface with various scoring designs on it, and using a solid or hollow wheel. The game is inexpensive, exciting, educational and therapeutic, and will provide many hours of enjoyment to its players.

The present invention is not intended to be restricted to any particular form or arrangement, or any specific embodiment disclosed herein, or any specific use, since the same may be modified in various particulars or relations without departing from the spirit or scope of the claimed invention hereinabove shown and described of which the methods shown are intended only for illustration and for disclosure of an operative embodiment and not to show all of the various forms of modifications in which the invention might be embodied.

The invention has been described in considerable detail in order to comply with the patent laws by providing a full public disclosure of at least one of its forms. However, such detailed description is not intended in any way to limit the broad features or principles of the invention, or the scope of claims appended hereto.

What is claimed is:

1. A skidwheel game comprising:

a longitudinally disposed generally flat surface having a design thereon;

said design comprising a plurality of zones, said zones being defined and separated from each other by boundary markers, said game including value indicating indicia associated with individual ones of said zones; and an automobile steering wheel having a central axis and a periphery, said wheel being adapted to be projected linearly with a reverse spin along the longitudinal axis of said surface so that the periphery of said wheel normally travels in contact with said longitudinally disposed generally flat surface whereby said wheel normally travels over said surface in first one direction and then rolls in a reverse direction in such a fashion that said wheel remains within said design and comes to rest within one of said zones, said reverse spin being about the central axis of said wheel and being in a direction which is opposite to that induced by the periphery of said wheel traveling over said surface in said first direction.

2. A skidwheel game as defined in claim 1, wherein said longitudinally disposed generally flat surface comprises a generally smooth structurally fixed rigid floor.

3. A skidwheel game as defined in claim 1, wherein said longitudinally disposed generally flat surface comprises a flexible membrane adapted to be supported on a generally smooth rigid substrate.

4. A skidwheel game as defined in claim 1, wherein said boundary markers include straight horizontal lines which run perpendicular to the longitudinal axis of said longitudinally disposed general flat surface.

5. A skidwheel game as defined in claim 1 wherein:

said value indicating indicia associated with individual ones of said zones are generally arranged in ascending order of value along said longitudinal axis, and one of said zones including a secondary zone within its boundary, said secondary zone containing a supplemental scoring value indicating indicia associated with said wheel traversing said secondary zone when said wheel is rolling in said reverse direction.

6. The method of playing a skidwheel game which comprises:

selecting a longitudinally disposed generally flat playing surface having a design thereon, said design including a plurality of visually discernible zones and value indicating indicia associated with individual ones of said zones;

assuming a position adjacent said design;

projecting a wheel linearly with a reverse spin along the longitudinal axis of said longitudinally disposed generally flat surface so that said wheel generally travels in contact with said longitudinally disposed generally flat surface in first one direction over said longitudinally disposed generally flat surface and then rolls in a reverse direction until it comes to rest in such a fashion that said wheel remains within the longitudinal boundaries of said design while traveling in said one direction and rolling in said reverse direction; and calculating a score based at least on where said wheel comes to rest with reference to said visually discernible zones.

* * * * *